US008740313B2

(12) United States Patent
Chiang

(10) Patent No.: US 8,740,313 B2
(45) Date of Patent: Jun. 3, 2014

(54) CUTTING TOOL HOLDING DEVICE

(71) Applicant: Everpads Co., Ltd., Taichung (TW)

(72) Inventor: Chun-Li Chiang, Taichung (TW)

(73) Assignee: Everpads Co., Ltd., Taichung (TW)

( * ) Notice: Subject to any disclaimer, the term of this patent is extended or adjusted under 35 U.S.C. 154(b) by 0 days.

(21) Appl. No.: 13/733,126

(22) Filed: Jan. 2, 2013

(65) Prior Publication Data

US 2013/0175848 A1 Jul. 11, 2013

(30) Foreign Application Priority Data

Jan. 6, 2012 (TW) ..... 101200376 A

(51) Int. Cl.
*E21C 35/19* (2006.01)

(52) U.S. Cl.
CPC ..... *E21C 35/19* (2013.01); *E21C 2035/191* (2013.01)
USPC ..... 299/102; 299/106; 299/110

(58) Field of Classification Search
CPC ..... E21C 35/18; E21C 35/19; E21C 35/197; E21C 2035/191
USPC ..... 299/102, 106, 107, 108, 110, 111
See application file for complete search history.

(56) References Cited

U.S. PATENT DOCUMENTS

| | | | | |
|---|---|---|---|---|
| 3,666,321 | A * | 5/1972 | Lundstrom et al. | 299/103 |
| 4,057,294 | A * | 11/1977 | Krekeler | 299/102 |
| 4,068,897 | A * | 1/1978 | Amoroso | 299/102 |
| 4,261,620 | A * | 4/1981 | Troxler | 299/113 |
| 4,275,929 | A * | 6/1981 | Krekeler | 299/102 |
| 4,343,516 | A * | 8/1982 | Aden | 299/106 |
| 4,542,943 | A * | 9/1985 | Montgomery, Jr. | 299/102 |
| 4,621,871 | A * | 11/1986 | Salani | 299/107 |
| 4,650,256 | A * | 3/1987 | Wetzinger | 299/107 |
| 4,693,518 | A * | 9/1987 | Sulosky et al. | 299/102 |
| 5,322,351 | A * | 6/1994 | Lent | 299/102 |
| 5,639,180 | A * | 6/1997 | Sulosky et al. | 404/17 |
| 6,386,641 | B2 * | 5/2002 | Mondy | 299/79.1 |
| 6,481,803 | B2 * | 11/2002 | Ritchey | 299/79.1 |
| 6,854,810 | B2 * | 2/2005 | Montgomery, Jr. | 299/106 |
| 7,537,288 | B2 * | 5/2009 | Chiang | 299/102 |
| 2004/0051370 | A1 * | 3/2004 | Montgomery, Jr. | 299/106 |
| 2009/0261646 | A1 * | 10/2009 | Ritchey et al. | 299/106 |

FOREIGN PATENT DOCUMENTS

GB 2247705 A * 3/1992

* cited by examiner

*Primary Examiner* — David Bagnell
*Assistant Examiner* — Michael Goodwin
(74) *Attorney, Agent, or Firm* — CKC & Partners Co., Ltd.

(57) ABSTRACT

A cutting tool holding device includes a base, a cutting tool holder and a fastening member. The base includes an abutting portion and a transverse dovetail groove, wherein the abutting portion is defined between a first wall with a mounting surface and a second wall, and the transverse dovetail groove is formed on the mounting surface. The cutting tool holder has a transverse dovetail portion, wherein the cutting tool holder is abutted against the abutting portion, and the transverse dovetail portion is detachably engaged into the transverse dovetail groove on the mounting surface of the second wall. The fastening member is for fastening the cutting tool holder to the base.

10 Claims, 12 Drawing Sheets

CUTTING TOOL HOLDING DEVICE

RELATED APPLICATIONS

The application claims priority to Taiwan Application Serial Number 101200376, filed Jan. 6, 2012, which is herein incorporated by reference.

BACKGROUND

1. Technical Field

The present invention relates to a holding device. More particularly, the present invention relates to a cutting tool holding device.

2. Description of Related Art

A cutting tool holding device for receiving a cutting tool is configured to be attached to a road planer for cutting, mining, excavating the ground or applying a surface roughness treatment to a road. Conventionally, a cutting tool holding device includes a base and a cutting tool holder for receiving a cutting tool. The base is fixed on a peripheral surface of a working member (such as a roller) of a machinery (such as a road planer), and the cutting tool holder is engaged with the base. The engagement of the cutting tool holder and the base is usually fixed by some fastening members, e.g., screws. The cutting tool received in the cutting tool holder is mounted along a tangent of the base for facilitating the excavating or cutting operations applied to the ground. In the working process of the aforementioned machinery, a excavating operation is first applied to a processed material (such as concrete or asphalt over a road) by the cutting tool; as the roller rotates, a cutting operation is then applied to the ground by the cutting tool, so as to destroy the processed material.

In general, the processed material is solid and stiff, and thus the cutting tool working on it only has a rather limited lifetime and needs a frequent replacement. Furthermore, in the working process a reaction force generated from the processed material is not only exerted on the cutting tool, but also on the base and the cutting tool holder. Therefore, when the base and the cutting tool holder are not firmly engaged, serious damages occur by the reaction force in the cutting tool holder and the base. As a result, the cutting tool holder and the base are also in need of the frequent replacement. Consequently, the maintenance cost of the cutting tool holding device is high in the art.

Therefore, it is important to reinforce the engagement between the base and the cutting tool holder for prolonging the life span of the cutting tool holding device, so as to reduce the maintenance costs thereof.

SUMMARY

According to one aspect of the present disclosure, a cutting tool holding device includes a base, a cutting tool holder and a fastening member. The base includes an abutting portion and a transverse dovetail groove, wherein the abutting portion is defined between a first wall with a mounting surface and a second wall, and the transverse dovetail groove is formed on the mounting surface. The transverse dovetail groove is parallel to a joint line of the first wall and the second wall. The cutting tool holder has a transverse dovetail portion, wherein the cutting tool holder is abutted against the abutting portion, the transverse dovetail portion is parallel to the joint line of the first wall and the second wall, and the transverse dovetail portion is detachably engaged into the transverse dovetail groove on the mounting surface of the second wall. The fastening member is for fastening the cutting tool holder to the base.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
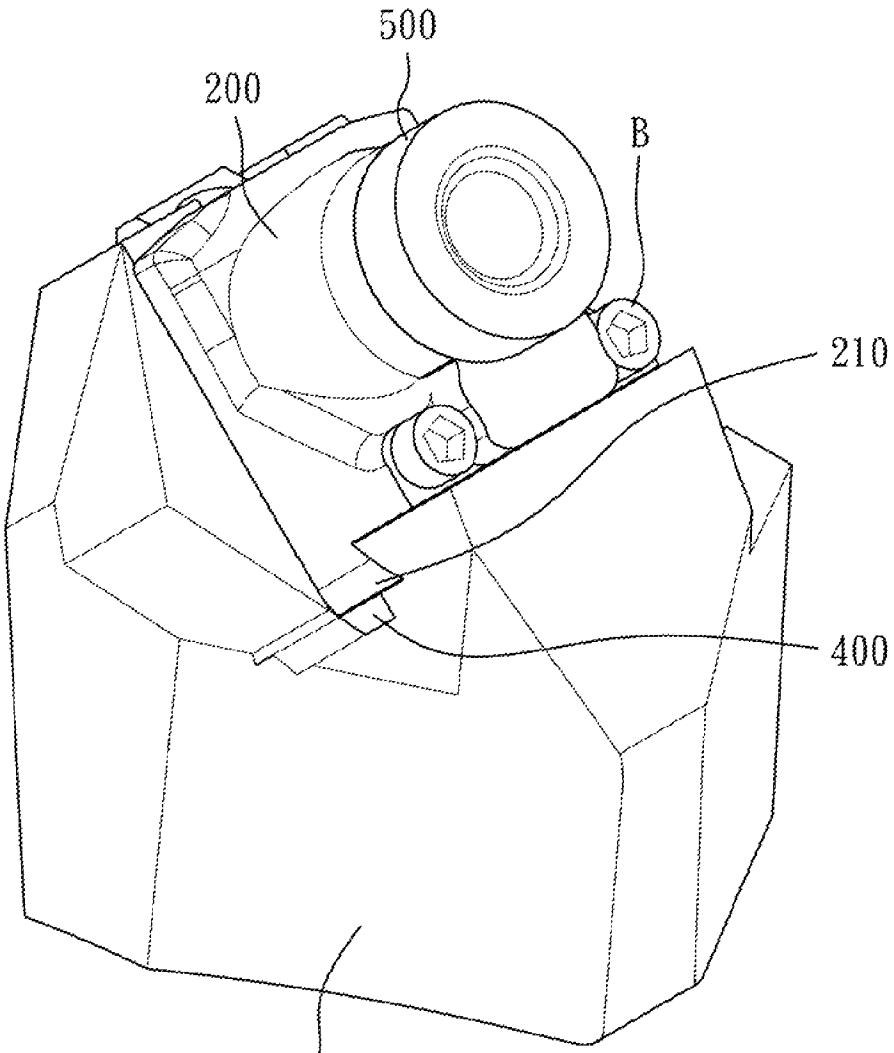
FIG. 1 is a perspective view of a cutting tool holding device according to one embodiment of the present disclosure.
Figure 2:
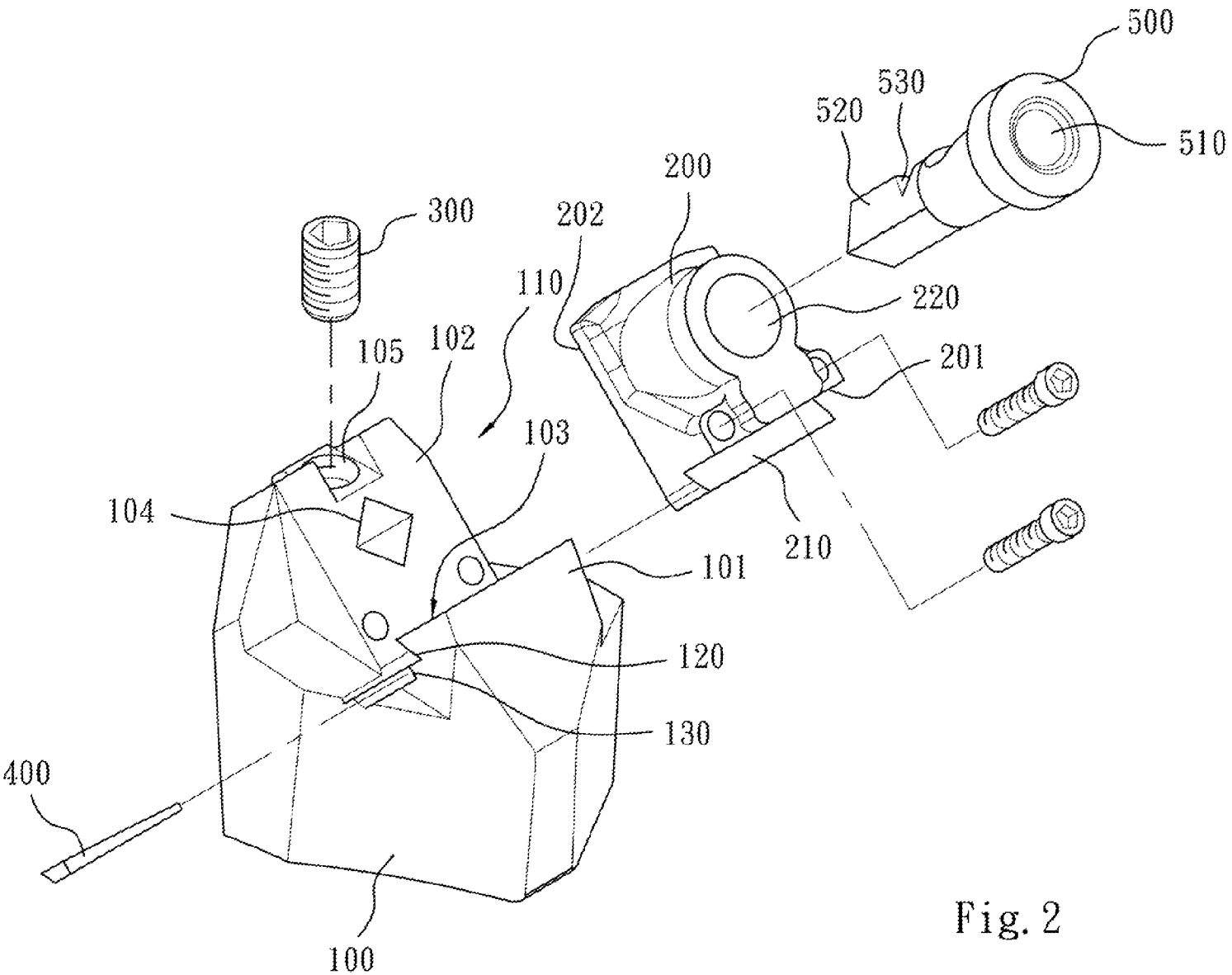
FIG. 2 is an exploded view of the cutting tool holding device shown in FIG. 1.
Figure 3:
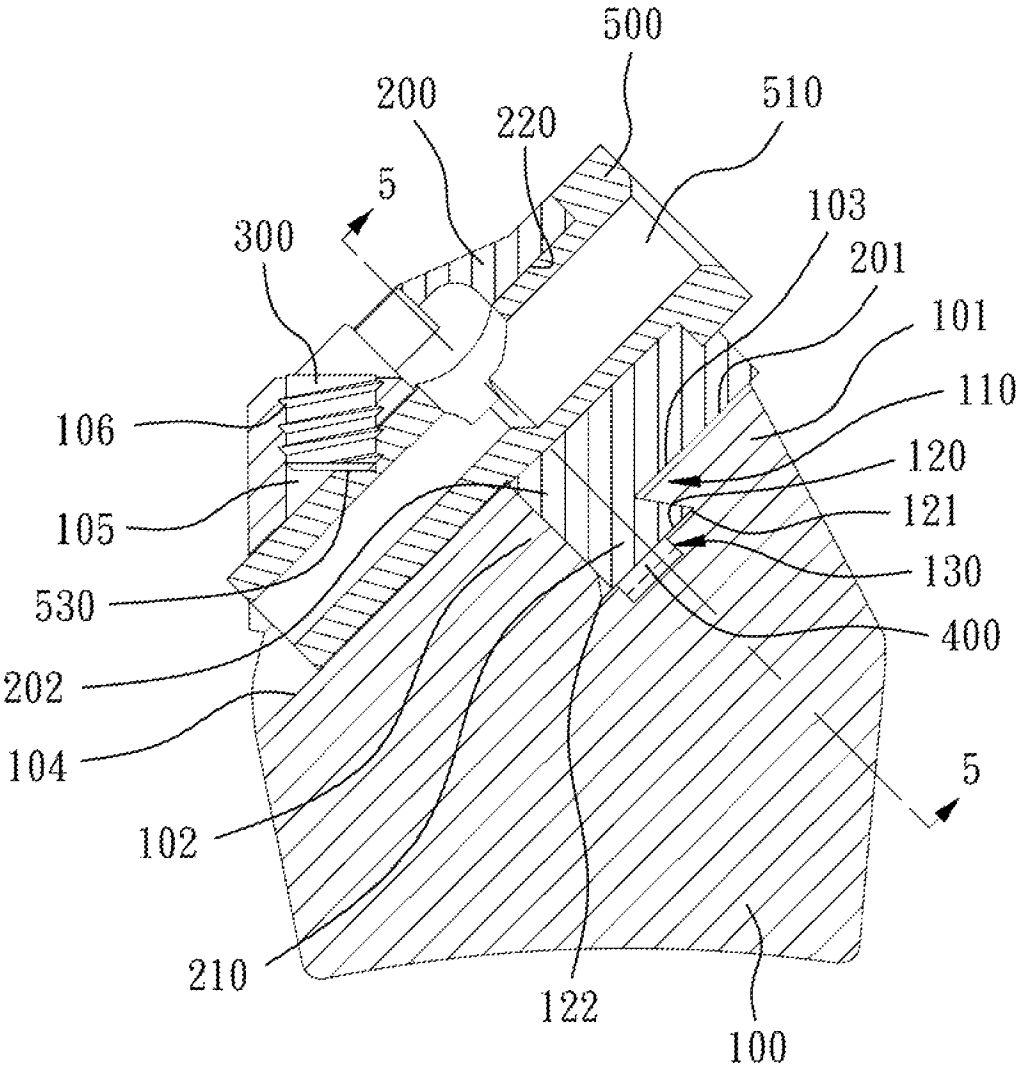
FIG. 3 is a cross-sectional view of the cutting tool holding device shown in FIG. 1.
Figure 4:
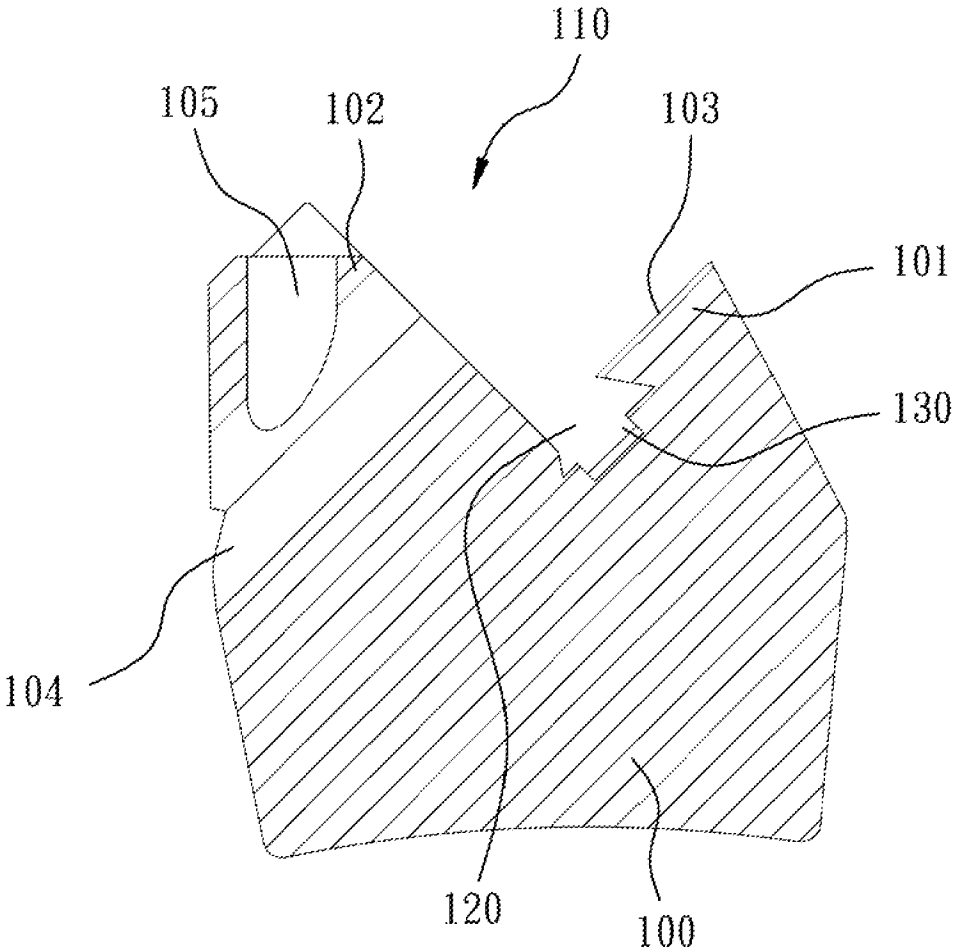
FIG. 4 is a cross-sectional view of a base shown in FIG. 3.
Figure 5:
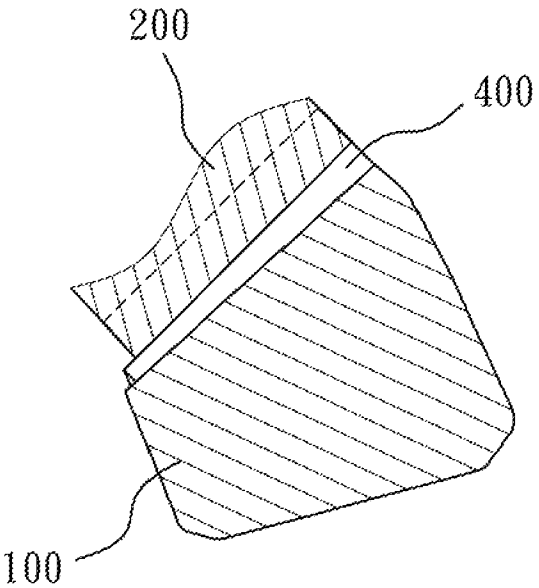
FIG. 5 is a partial cross-sectional view of the cutting tool holding device along line 5-5 shown in FIG. 3.
Figure 6:
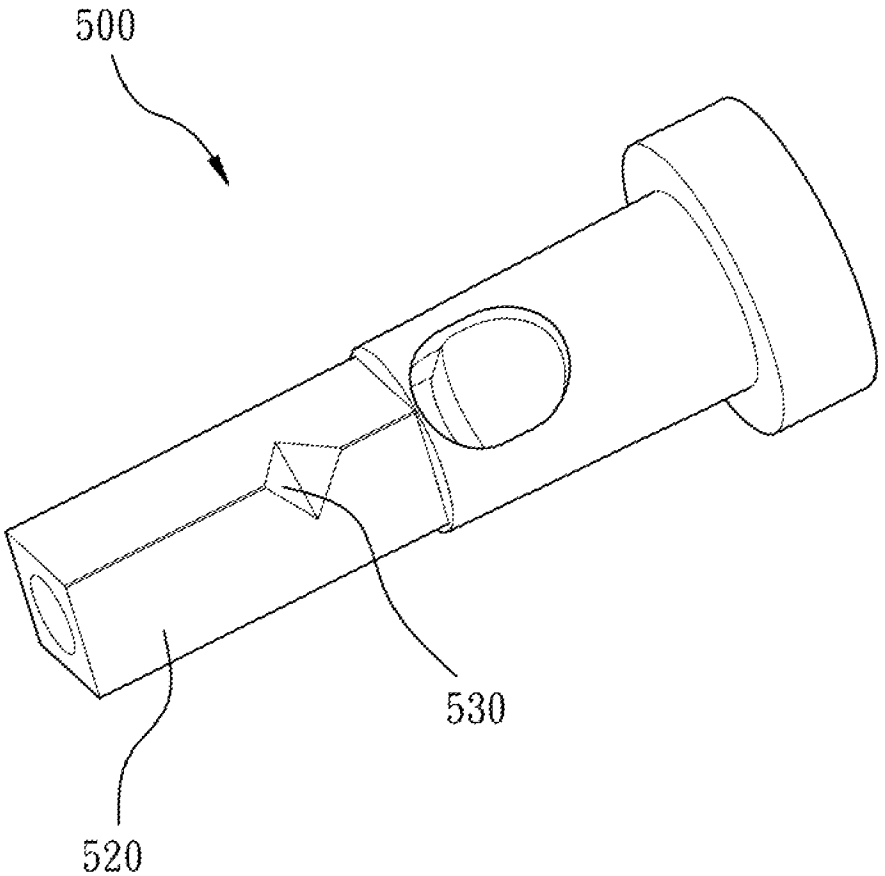
FIG. 6 is a perspective view of a positioning member shown in FIG. 2.

FIG. 1 is a perspective view of a cutting tool holding device according to one embodiment of the present disclosure. FIG. 2 is an exploded view of the cutting tool holding device shown in FIG. 1. FIG. 3 is a cross-sectional view of the cutting tool holding device shown in FIG. 1. FIG. 4 is a cross-sectional view of a base 100 shown in FIG. 3. FIG. 5 is a partial cross-sectional view of the cutting tool holding device along line 5-5 shown in FIG. 3. FIG. 6 is a perspective view of a positioning member 500 shown in FIG. 1. In FIG. 1 to FIG. 6, the cutting tool holding device includes the base 100, a cutting tool holder 200, a fastening member 300, a pressing member 400 and the positioning member 500.

The base 100 includes an abutting portion 110, a transverse dovetail groove 120 and a depression space 130. The abutting portion 110 is defined between a first wall 101 with a mounting surface 103 and a second wall 102. The transverse dovetail groove 120 is formed on the mounting surface 103 and has two asymmetric groove ends 121, 122. The transverse dovetail groove 120 is parallel to a joint line of the first wall 101 and the second wall 102. The transverse dovetail groove 120 is substantially perpendicular to a central axis of a receiving hole 510 of the positioning member 500. The depression space 130 is formed on a bottom surface of the transverse dovetail groove 120, and the depression space 130 is substantially rectangular. The base 100 further includes a square mounting hole 104 penetrating the second wall 102 and a fastening hole 105 communicated with the mounting hole 104. The fastening hole 105 has screw threads 106 formed on a surface thereof, and the first wall 101 and the second wall 102 have an included angle not greater than 90 degrees.

The cutting tool holder 200 includes a first surface 201 and a second surface 202, wherein the first surface 201 and the second surface 202 are respectively abutted against the first wall 101 and the second wall 102. The cutting tool holder 200 is abutted against the abutting portion 110, and has a transverse dovetail portion 210. The transverse dovetail portion 210 is parallel to the joint line of the first wall 101 and the second wall 102. The transverse dovetail portion 210 is detachably engaged into the transverse dovetail groove 120. The transverse dovetail portion 210 has two asymmetric tail ends respectively corresponding to the two asymmetric groove ends 121, 122 of the transverse dovetail groove 120. The cutting tool holder 200 further includes a holding hole 220 penetrating the cutting tool holder 200, and the holding hole 220 is substantially coaxial with the mounting hole 104.

Figure 7:
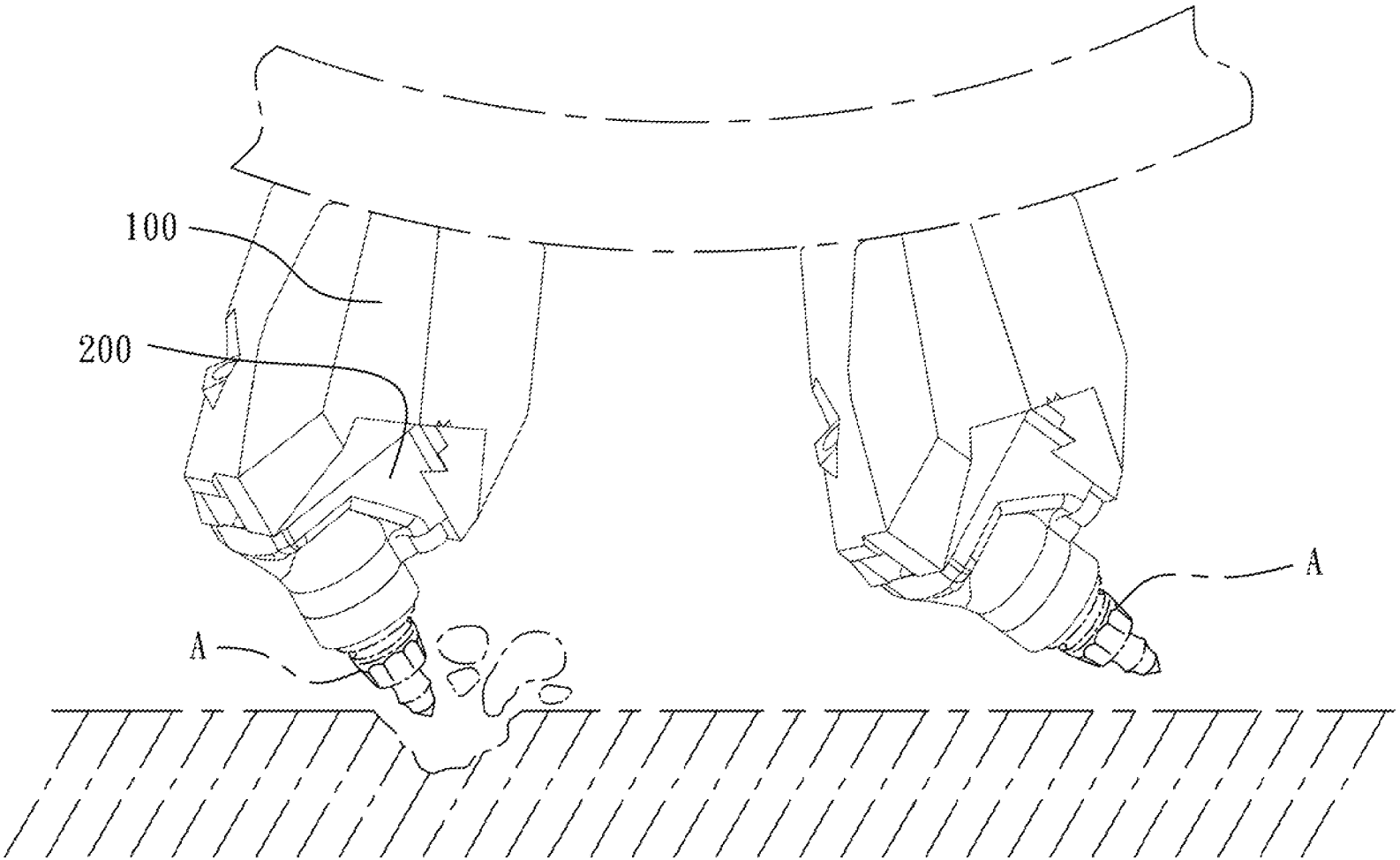
FIG. 7 is an operating schematic view of the cutting tool holding device shown in FIG. 1.

The positioning member 500 is inserted through the holding hole 220 and the mounting hole 104, and includes the receiving hole 510 configured for receiving the cutting tool A (shown in FIG. 7). An end 520 of the positioning member 500 is square corresponding to the mounting hole 104, whereby a relative rotation between the positioning member 500 and the mounting hole 104 cab be avoided. The positioning member 500 further includes a first indentation 530 corresponding to the fastening hole 105, whereby the fastening member 300 presses against the first indentation 530.

The fastening member 300 engages with the screw threads 106 of the fastening hole 105 and presses against the first indentation 530 of the positioning member 500, so that the cutting tool holder 200 can be firmly fastened to the base 100.

The pressing member 400 is installed in the depression space 130, and is substantially a rectangular bar corresponding to the depression space 130. The pressing member 400 has a thickness changing gradually along a direction of a length thereof. As a result, the pressing member 400 can press the transverse dovetail portion 210 towards the transverse dovetail groove 120, and the cutting tool holder 200 can be positioned stably on the base 100. In the example, a ratio of the thickness of the pressing member 400 to the length of the pressing member 400 is 1/20.

According to the foregoing embodiment of the disclosure, the engagement between the transverse dovetail portion 210 of the cutting tool holder 200 and the transverse dovetail groove 120 of the base 100 can be reinforced by the pressing member 400. The shape of the pressing member 400 can further enhance the fastening degree between the cutting tool holder 200 and the base 100. Therefore, a displacement between the cutting tool holder 200 and the base 100 resulted from a reaction force can be avoided. Also, the transverse dovetail groove 120 is substantially perpendicular to the central axis of the receiving hole 510 of the positioning member 500, which can enhance a load value of the cutting tool holder 200 and a load value of the base 100 for the reaction force. Therefore, the life span of the cutting tool holder 200 and the base 100 can be prolonged, and the maintenance cost can be reduced.

Furthermore, a surface of the depression space 130 can have a threaded hole for a screw pressing against the pressing member 400, so that the pressing member 400 can be positioned well and will not be displaced by the reaction force. Moreover, the fastening degree between the cutting tool holder 200 and the base 100 can be enhanced by some screw members B.

FIG. 7 is an operating schematic view of the cutting tool holding device shown in FIG. 1. In FIG. 7, the base 100 is fixed on a peripheral surface of a working member (such as a roller) of a machinery (such as a road planer).

Figure 8:
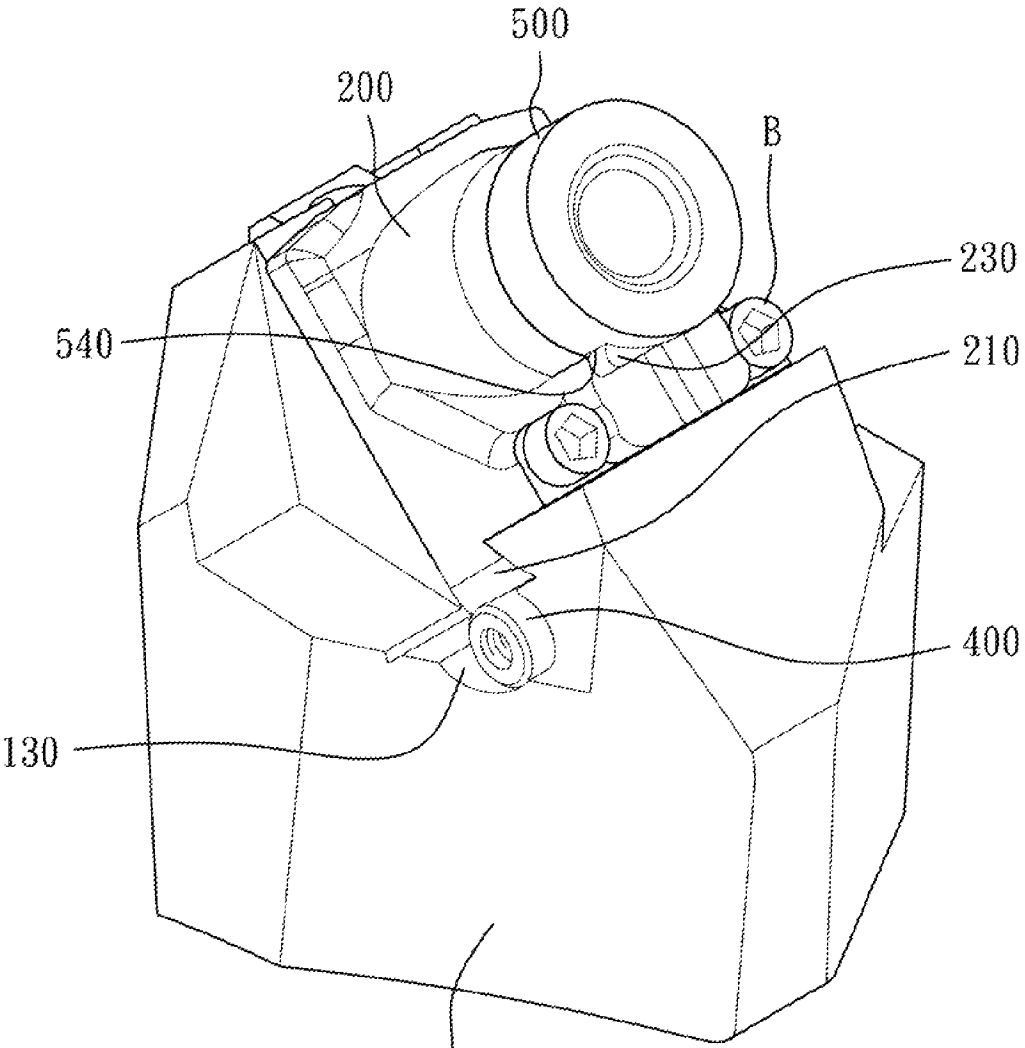
FIG. 8 is a perspective view of a cutting tool holding device according to another embodiment of the present disclosure.
Figure 9:
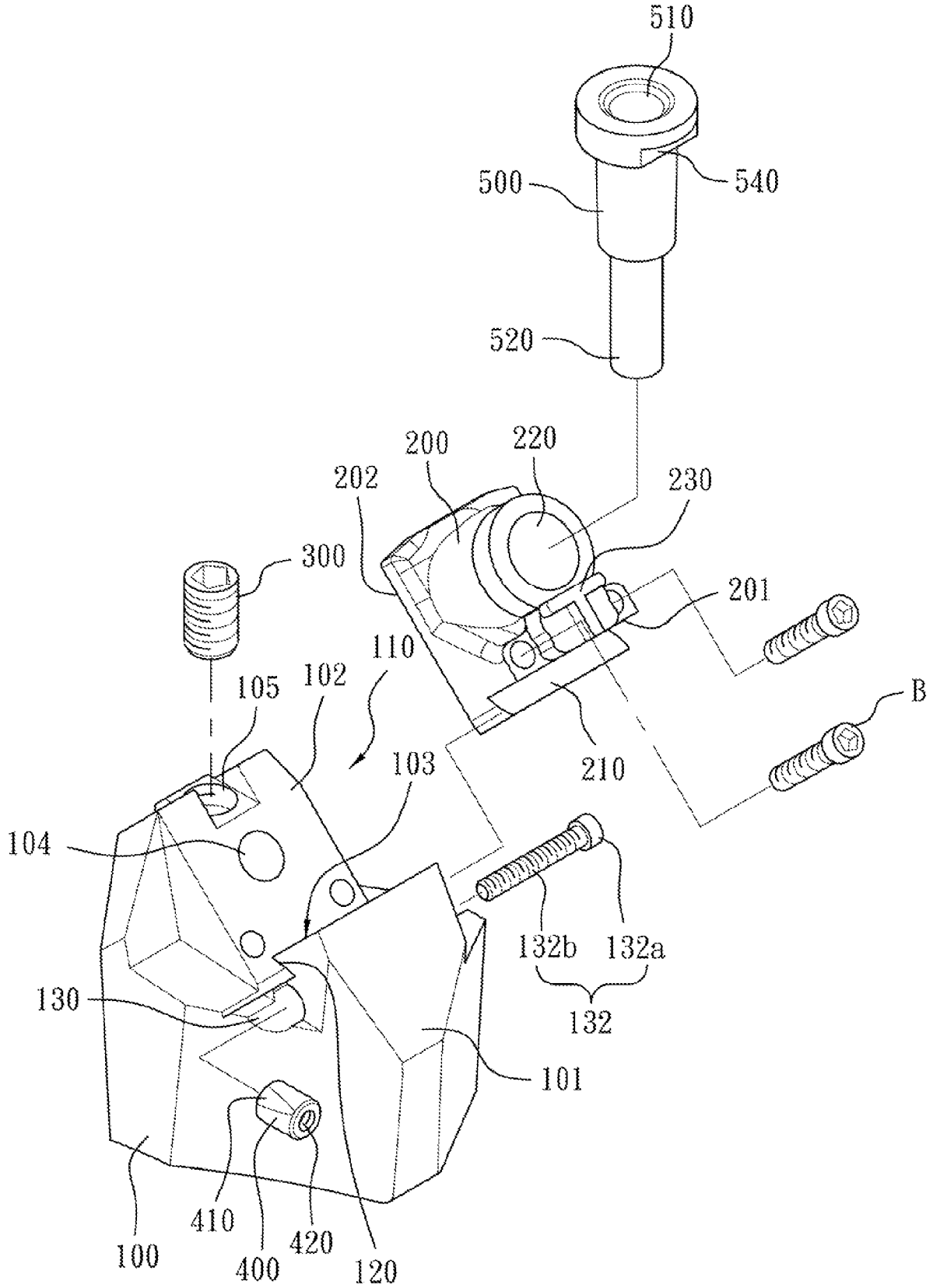
FIG. 9 is an exploded view of the cutting tool holding device shown in FIG. 8.
Figure 10:
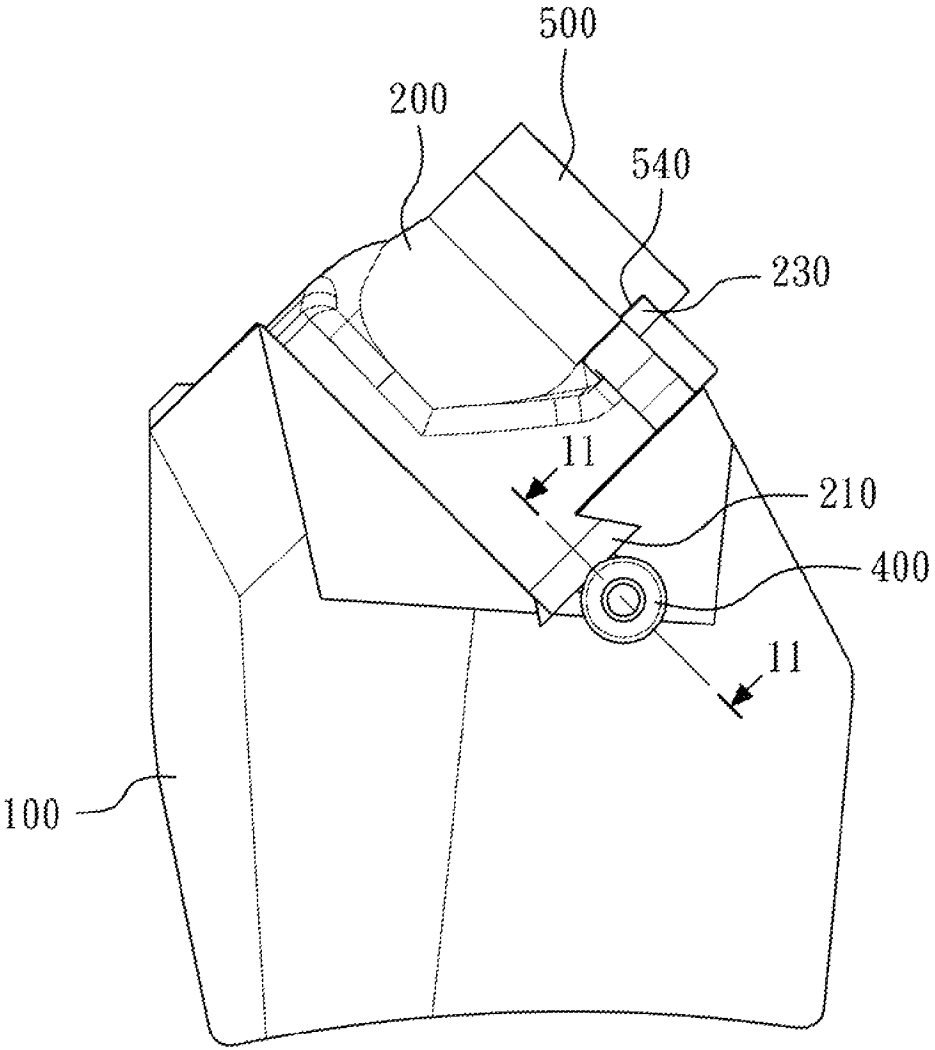
FIG. 10 is a side view of the cutting tool holding device shown in FIG. 8.
Figure 11:
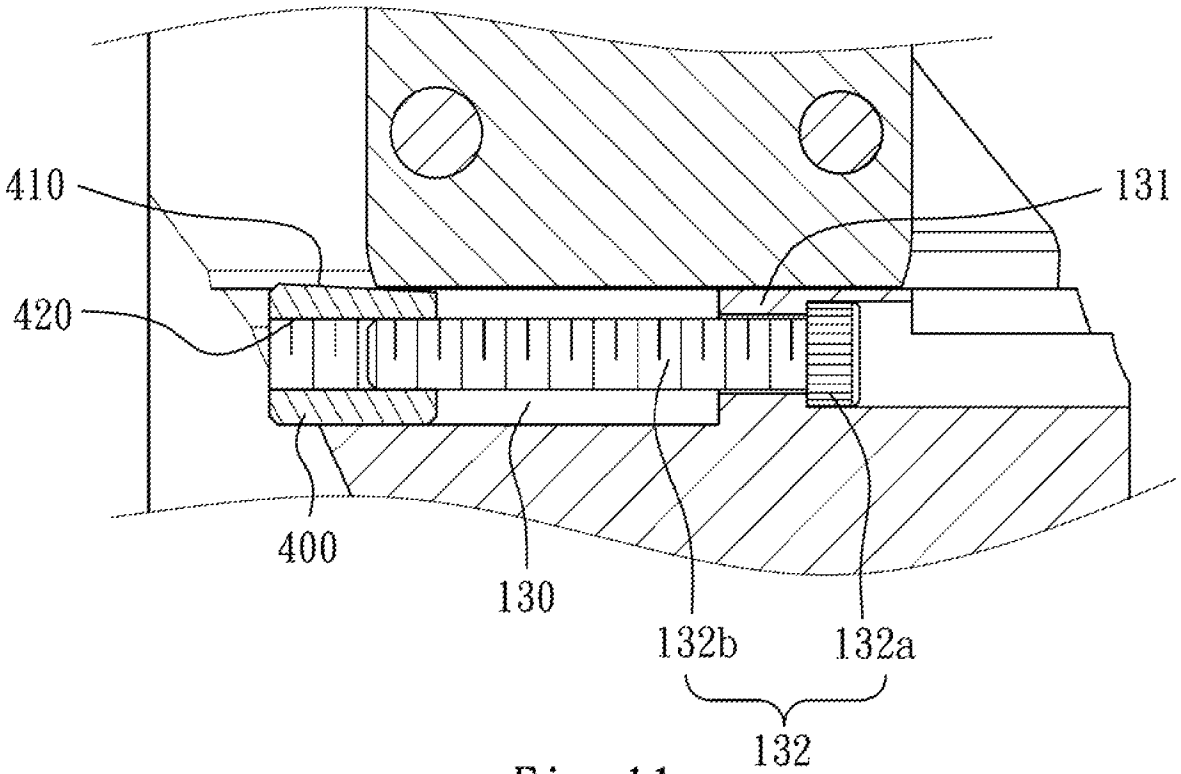
FIG. 11 is a partial cross-sectional view of the cutting tool holding device along line 11-11 shown in FIG. 10.
Figure 12:
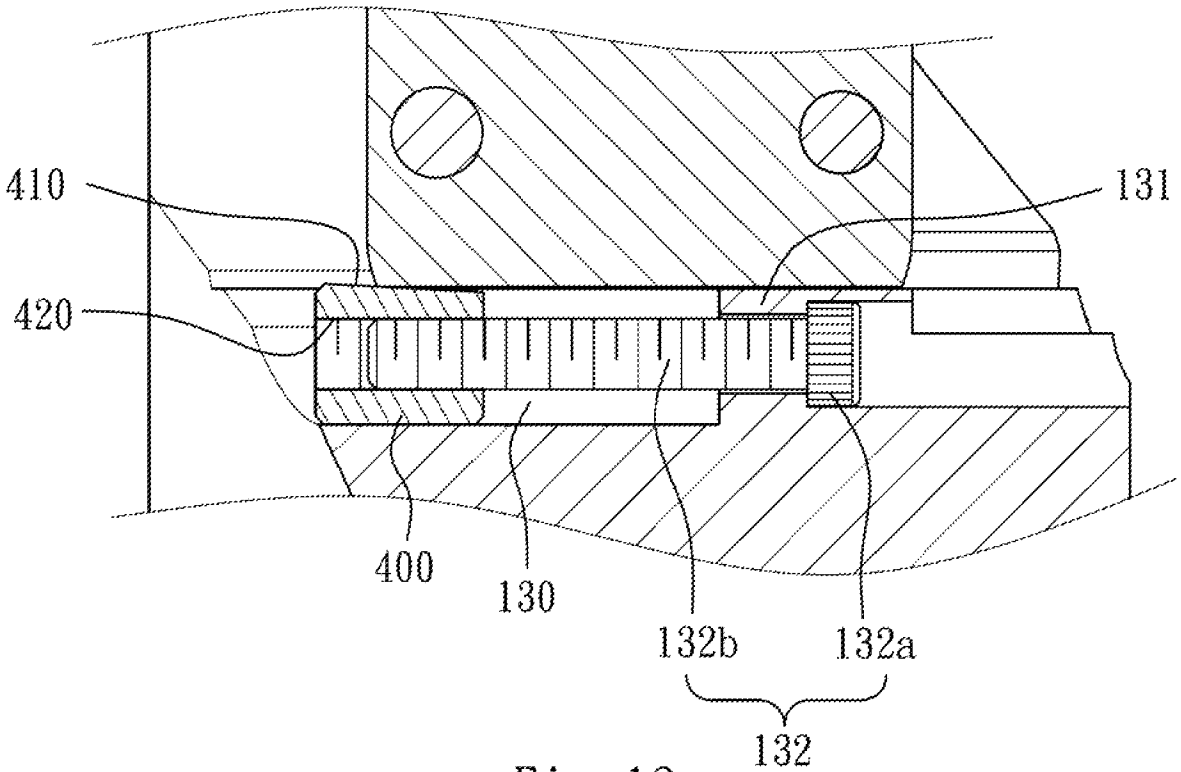
FIG. 12 is another partial cross-sectional view of the cutting tool holding device along line 11-11 shown in FIG. 10.

FIG. 8 is a perspective view of a cutting tool holding device according to another embodiment of the present disclosure. FIG. 9 is an exploded view of the cutting tool holding device shown in FIG. 8. FIG. 10 is a side view of the cutting tool holding device shown in FIG. 8. FIG. 11 is a partial cross-sectional view of the cutting tool holding device along line 11-11 shown in FIG. 10. FIG. 12 is another partial cross-sectional view of the cutting tool holding device along line 11-11 shown in FIG. 10. In FIG. 9, a mounting hole 104 of a base 100 is circular, and an end 520 of a positioning member 500 is also circular corresponding to the mounting hole 104 so as to allow the positioning member 500 to embed in the mounting hole 140. The positioning member 500 further includes a second indentation 540. The second indentation 540 is disposed at an end of the positioning member 500 where the cutting tool A (shown in FIG. 7) is fed in. A cutting tool holder 200 further includes a protruding portion 230. The protruding portion 230 is disposed corresponding to the second indentation 540, whereby the protruding portion 230 fits in the second indentation 540. Therefore, a relative rotation between the positioning member 500 and the mounting hole 104 can be avoided.

In the embodiment, a depression space 130 is substantially circular, and a narrow portion 131 and a first screw member 132 (shown in FIG. 11 and FIG. 12) are disposed in the depression space 130. The first screw member 132 has a head 132*a* and a threaded body 132*b*. The head 132*a* is located at an end of the narrow portion 131, and the threaded body 132*b* through the narrow portion 131 protrudes from the other end of the narrow portion 131. A radial dimension of the head 132*a* is greater than a radial dimension of the depression space 130 at the narrow portion 131. Therefore, the head 132*a* is not allowed to move to the other end of the narrow portion 131 and a position of the first screw member 132 is confined thereby. The pressing member 400 is substantially formed in a tube shape corresponding to the depression space 130. An inclined plane 410 is disposed on an outer surface of the pressing member 400. A tightening thread 420 is disposed on an inner surface of the pressing member 400 for engaging with the threaded body 132*b* of the first screw member 132, whereby the pressing member 400 can be driven by the first screw member 132 for changing a pressing degree between the inclined plane 410 and the cutting tool holder 200. As shown in FIG. 11 and FIG. 12, the pressing degree between the inclined plane 410 and the cutting tool holder 200 increases as the pressing member 400 moves into the depression space 130.

According to the foregoing embodiment of the disclosure the cutting tool holding device has advantages as follows. First, the engagement between the transverse dovetail portion and the transverse dovetail groove can enhance the load value of the cutting tool holder and the base for the reaction force, so that the replacement frequency is lower. Accordingly, the maintenance costs can be reduced. Second, the ratio of the thickness of the pressing member to the length of the pressing member is 1/20, which can both reinforce the fastening degree between the cutting tool holder and the base and the engagement between the transverse dovetail portion and the transverse dovetail groove.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A cutting tool holding device, comprising:

a base, comprising:

an abutting portion defined between a first wall with a mounting surface and a second wall; and a transverse dovetail groove formed on the mounting surface, wherein the transverse dovetail groove is parallel to a joint line of the first wall and the second wall, a bottom surface of the transverse dovetail groove has a depression space, and the depression space is substantially rectangular;

a cutting tool holder having a transverse dovetail portion, wherein the cutting tool holder is abutted against the abutting portion, the transverse dovetail portion is parallel to the joint line of the first wall and the second wall, and the transverse dovetail portion is detachably engaged into the transverse dovetail groove on the mounting surface of the second wall;

a fastening member for fastening the cutting tool holder to the base; and a pressing member installed in the depression space, wherein the pressing member having a thickness changing gradually along a direction of a length thereof is configured for pressing and positioning the cutting tool holder, the pressing member is substantially a rectangular bar corresponding to the depression space, and a ratio of the thickness of the pressing member to the length of the pressing member is 1/20.

2. The cutting tool holding device of claim 1, wherein:

the base further comprises a mounting hole penetrating the second wall and a fastening hole communicated with the mounting hole, and the first wall and the second wall has an included angle not greater than 90 degrees;

the cutting tool holder further comprises a holding hole penetrating the cutting tool holder, and the holding hole is substantially coaxial with the mounting hole;

a positioning member is inserted through the mounting hole and the holding hole, and the positioning member comprises a receiving hole configured for receiving a cutting tool; and the fastening member is configured for being inserted into the fastening hole to press against the positioning member.

3. The cutting tool holding device of claim 2, wherein the mounting hole is square, and an end of the positioning member is also square corresponding to the mounting hole, whereby a relative rotation between the positioning member and the mounting hole is avoided.

4. The cutting tool holding device of claim 2, wherein the positioning member further comprises a first indentation corresponding to the fastening hole, whereby the fastening member presses against the first indentation.

5. The cutting tool holding device of claim 2, wherein the transverse dovetail groove is substantially perpendicular to a central axis of the receiving hole of the positioning member.

6. The cutting tool holding device of claim 2, wherein:

the positioning member further comprises a second indentation disposed at an end where the cutting tool is fed in; and the cutting tool holder further comprises a protruding portion disposed corresponding to the second indentation, whereby the protruding portion fits in the second indentation.

7. The cutting tool holding device of claim 2, wherein the mounting hole is circular, and an end of the positioning member is also circular corresponding to the mounting hole so as to allow the positioning member to embed in the mounting hole.

8. The cutting tool holding device of claim 1, wherein:

the transverse dovetail groove has two asymmetric groove ends; and the transverse dovetail portion has two asymmetric tail ends respectively corresponding to the two asymmetric groove ends of the transverse dovetail groove.

9. The cutting tool holding device of claim 1, wherein a surface of the depression space has a threaded hole for a screw pressing against the pressing member.

10. A cutting tool holding device, comprising:

a base, comprising:

an abutting portion defined between a first wall with a mounting surface and a second wall; and a transverse dovetail groove formed on the mounting surface, wherein the transverse dovetail groove is parallel to a joint line of the first wall and the second wall, a bottom surface of the transverse dovetail groove has a depression space, the depression space is substantially circular, a narrow portion and a first screw member are disposed in the depression space, the first screw member has a head and a threaded body, the head is located at an end of the narrow portion, the threaded body inserts through the narrow portion and protrudes from the other end of the narrow portion, and a position of the first screw member is confined by the narrow portion;

a cutting tool holder having a transverse dovetail portion, wherein the cutting tool holder is abutted against the abutting portion, the transverse dovetail portion is parallel to the joint line of the first wall and the second wall, and the transverse dovetail portion is detachably engaged into the transverse dovetail groove on the mounting surface of the second wall;

a fastening member for fastening the cutting tool holder to the base; and a pressing member installed in the depression space, wherein the pressing member having a thickness changing gradually along a direction of a length thereof is configured for pressing and positioning the cutting tool holder, the pressing member is substantially formed in a tube shape corresponding to the depression space, an inclined plane is disposed on an outer surface of the pressing member, a tightening thread is disposed on an inner surface of the pressing member for engaging with the threaded body of the first screw member, whereby the pressing member is driven by the first screw member for changing a pressing degree between the inclined plane and the cutting tool holder.

* * * * *